US006792651B2

(12) United States Patent
Weiland et al.

(10) Patent No.: US 6,792,651 B2
(45) Date of Patent: Sep. 21, 2004

(54) IN-FLOOR, ADJUSTABLE, MULTIPLE-CONFIGURATION TRACK ASSEMBLY FOR SLIDING PANELS WITH BUILT-IN WEEP SYSTEM

(76) Inventors: William R. Weiland, 2042 Sheridan, Encinitas, CA (US) 92024; Robert A. Ulibarri, 8018 Sitio Caucho, Carlsbad, CA (US) 92009

( * ) Notice: Subject to any disclaimer, the term of this patent is extended or adjusted under 35 U.S.C. 154(b) by 80 days.

(21) Appl. No.: 10/185,942

(22) Filed: Jun. 27, 2002

(65) Prior Publication Data

US 2004/0000027 A1 Jan. 1, 2004

(51) Int. Cl.[7] ..... A47H 15/00; E05D 15/16

(52) U.S. Cl. ..... 16/102; 16/96 R

(58) Field of Search ..... 16/96 R, 93 R, 16/94 R, 95 R, 87 R, 87.4 R, 1.2; 49/408, 409, 404, 410, 411; 312/349; 52/218, 219, 204.54, 204.5, 204.71; 160/194, 197, 201, 204–207; 4/601–610

(56) References Cited

U.S. PATENT DOCUMENTS

| | | | | | |
|---|---|---|---|---|---|
| 204,006 | A | * | 5/1878 | Condict, Jr. | 238/10 R |
| 4,073,035 | A | * | 2/1978 | Baus | 16/96 R |
| 4,208,755 | A | * | 6/1980 | Shepherd | 15/160 |
| 4,358,863 | A | * | 11/1982 | Jacobsen | 4/607 |
| 5,136,814 | A | * | 8/1992 | Headrick | 49/468 |
| 5,179,804 | A | * | 1/1993 | Young | 49/471 |
| 5,341,600 | A | * | 8/1994 | Heppner | 49/471 |
| 5,671,501 | A | * | 9/1997 | Laramie | 16/96 R |
| 6,371,188 | B1 | * | 4/2002 | Baczuk et al. | 160/92 |

FOREIGN PATENT DOCUMENTS

| | | | |
|---|---|---|---|
| AU | 200048797 A | * | 2/2001 |
| GB | 1537347 | * | 12/1978 |
| JP | 04336191 A | * | 11/1992 |
| JP | 08028144 A | * | 1/1996 |
| JP | 08199927 A | * | 8/1996 |
| JP | 2000-129741 A | * | 5/2000 |
| JP | 2000-129742 A | * | 5/2000 |

* cited by examiner

*Primary Examiner*—Chuck Y. Mah
(74) *Attorney, Agent, or Firm*—Morrison & Foerster LLP

(57) ABSTRACT

In-floor, adjustable, track assembly for sliding panels with a build-in weep system, including a track, extending upward from a base, for engaging the undercarriage of a vertically-oriented panel, and supporting rectilinear motion therealong, an upright splash guard, parallel to and spaced slightly apart from one side of the upright track and forming, with the track, a channel therebetween with the base, for directing moisture from the bottom of the panel into the channel, at least one collection pan mounted under the channel and accessible through an aperture to collect moisture from the channel, and a hose for drawing off the moisture from the channel.

14 Claims, 5 Drawing Sheets

IN-FLOOR, ADJUSTABLE, MULTIPLE-CONFIGURATION TRACK ASSEMBLY FOR SLIDING PANELS WITH BUILT-IN WEEP SYSTEM

BACKGROUND OF THE INVENTION

1. Field of the Invention

This invention relates to the field of sliding door assembly and installation. More particularly, the invention pertains to a novel floor support system for sliding glass or non-glass panels, that act as doors or room dividers, and to a system for supporting them on a floor-level track including means for draining off water that accumulates on the floor or on either side of the door.

2. Description of the Prior Art

Traditional devices undergo change as our culture matures. The common door, mounted on hinges along one vertical side and arranged to swing through an arc, has given way in part to panels that slide on tracks and disappear into walls, sandwich with other such panels, spread apart to divide a room, or give access from one room to another. In many cases, a plurality of glass panels slides on a single track or on separate, but closely parallel, tracks to form a temporary wall, to divide a room into smaller rooms, or to provide an opening from one room onto a balcony, onto a patio, onto a swimming pool area and the like.

A significant problem with these types of sliding panels occurs where one side of the panels faces outside the home or building toward the elements. Rain, sleet or snow hitting the glass and panel is drawn downward by gravity so that it puddles at the bottom of the panel and, when in great enough quantities, spills over onto the tracks upon which the panels are mounted for sliding movement. In other situations, the floor on one side of the track is slanted such that rain or melted snow runs toward the track. Once the moisture reaches the tracks, problems develop because of the many directions the moisture may flow. For instance, it sometimes flows under the panel and into a room wetting carpets and rugs that thereafter become stained, crispy, or develop an organic growth that causes bad odors and attracts insects. The moisture sometimes flows outward from the panel and stains concrete or causes deterioration of cement and wood flooring, or corrodes the glue that holds down floor coverings such as linoleum, parquet, and vinyl squares.

Often the moisture draws dirt, dust, small insects and bits of leaves and flowers toward the track system. Accumulation of this debris causes the wheels mounted on the panels to become harder to rotate and, in severe cases, seize and refuse to turn, making the panel difficult to move in its intended path. Cleaning these tracks is often difficult and all the debris is rarely removable due to the closeness of the tracks. Often, the panels must be removed and this can be a difficult task. In winter seasons, the moisture often freezes thereby anchoring the panel to its present position and eliminating the desirability of having slidable panels in the first place.

In severe cases, the moisture puddles in the tracks and the subfloor on which the tracks are mounted is weakened. Concrete will crack under freezing and thawing of water and wood beams and wood floors can become weakened by constant exposure to water. Often, the mere beginning of such damage will cause tilting of the tracks and unbalancing of the load of the panels so that they refuse to slide easily along the tracks. Accordingly, it is desirable to provide a system that will capture the moisture and convey it from the track system before such problems begin to develop.

SUMMARY OF THE INVENTION

This invention is an in-floor, adjustable, track assembly for sliding panels with a built-in weep system to collect and thereafter remove the moisture from the track area where, when installation is complete, the exposed surface of the track is minimal resulting in a smooth transition from interior to exterior. It is useful on single or multiple track systems in areas that are divided by the panels into an exterior or outside section and an interior or inside section. This system finds use where the tracks are mounted on a base, are single tracks or are in closely spaced-apart, parallel arrangement and extend upward from the base for engaging the undercarriage of at least two vertically-oriented panels in close arrangement.

The invention provides for splash guards arranged parallel to and spaced slightly apart from one side of each track, preferably the interior area, and forming, with each track, a channel with the base, for collecting moisture from the floor. At least one collection pan is mounted under each channel, to collect moisture from the channel, and includes a tube or other means to draw off the moisture from the collection pan to a distant location.

Much of the invention is formed of extruded metal, such as aluminum, so that the cost of construction is minimized. Further, the invention is fully adjustable in vertical, as well as horizontal, directions so that it can be placed in new construction and installed in existing construction as well. Other parts are made of plastic and rubber so that the entire system is generally free from problems of corrosion even in the face of constant exposure to moisture.

Accordingly, the main object of this invention is an in-floor, adjustable, track assembly for sliding panels with a built-in weep system that will remove moisture that flows across the floor, and possibly across the track, or that trickles down the sliding panels to puddle at the bottom thereof. Another object of the invention is a fully adjustable track assembly that may be adjusted to compensate for warpage, weakness, and misalignment of walls with floors to allow the panels to slide effortlessly over the track.

These and other objects of the invention will become more apparent when reading the subsequent Description of the Preferred Embodiment taken together with the drawings appended hereto. The scope of protection desired by the inventor may be gleaned from a fair reading of the claims that conclude this Specification.

DESCRIPTION OF THE PREFERRED EMBODIMENT

Figure 1:
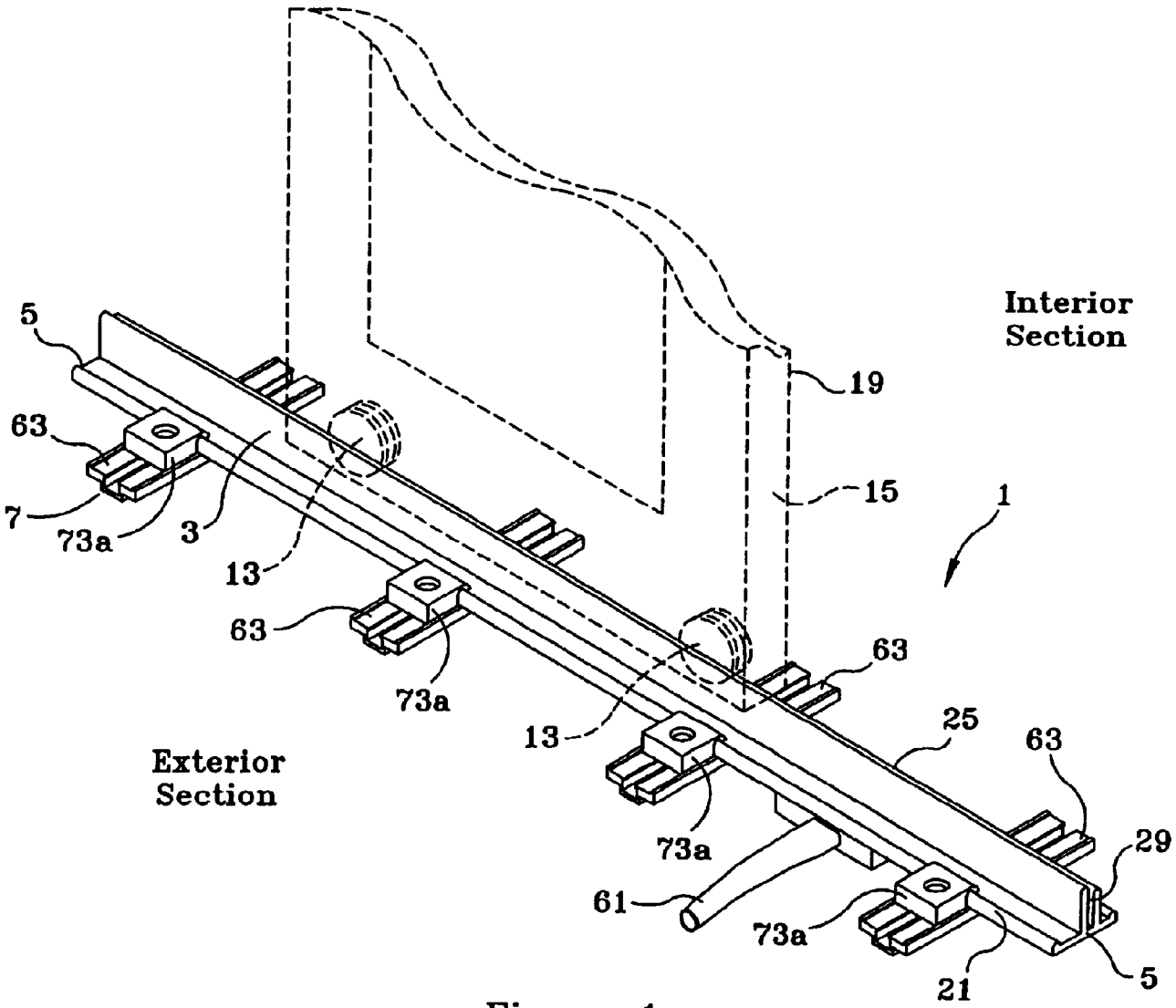
FIG. 1 is an illustrative view of a single track and weep system according to this invention.
Figure 2:
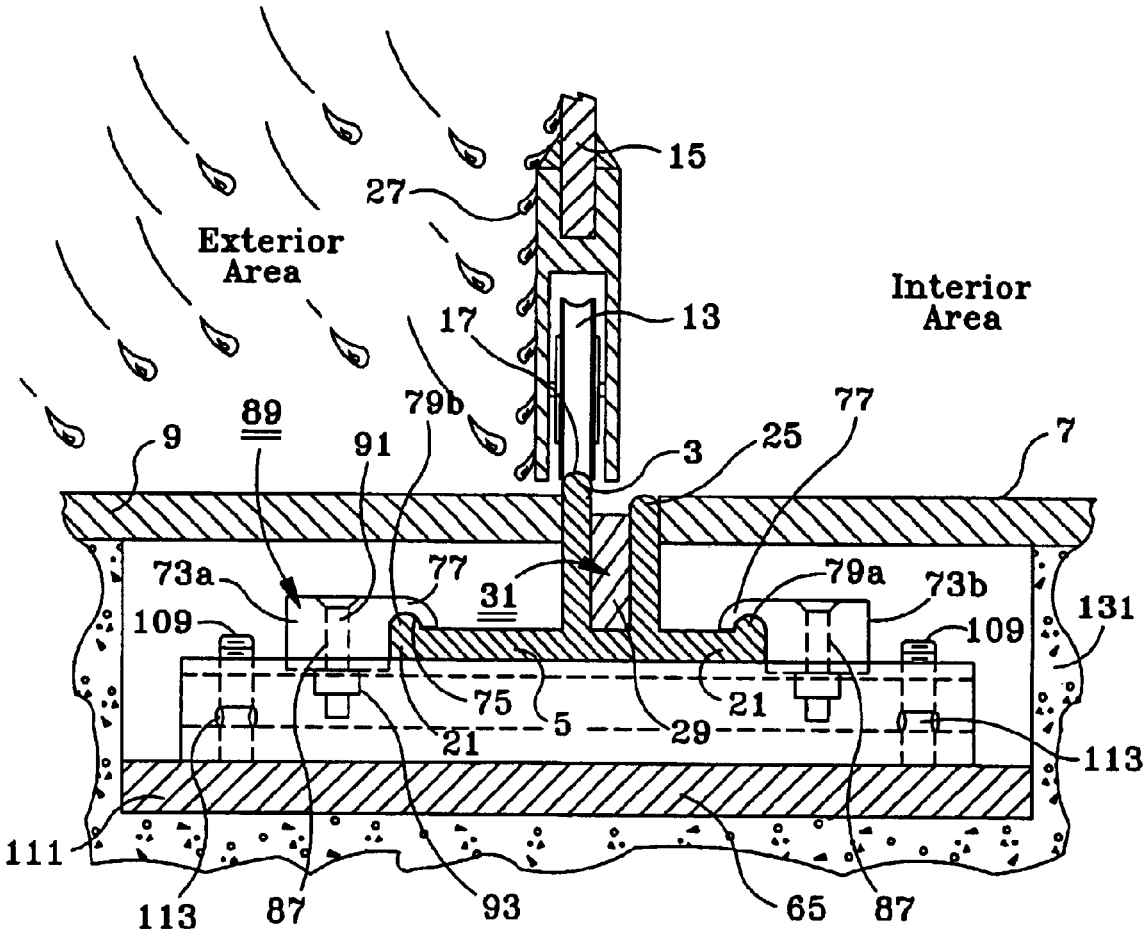
FIG. 2 is a sectional view taken through the single track and weep system shown in FIG. 1 depicting the narrow moisture collection channel of this invention.

Turning now to the drawings, wherein elements are identified by numbers and like elements are identified by like numbers throughout the ten figures, FIG. 1 shows the in-floor, adjustable, single configuration track assembly 1 for a sliding panel with a built-in weep system of this invention to comprise a narrow, elongated track 3 extending upward from a base 5, slightly above the top surface 7 of finished floor 9 for engaging the undercarriage wheels 13 of a panel 15 (wheels 13 and panel 15 are shown in phantom outline) and supporting panel 15 while it is in motion, such as in rectilinear motion, on track 3. As shown in FIGS. 1 and 2, it is preferred that track 3 is an upright, elongated, narrow-gauge metal plate forming an inverted "T" shape with base 5. Track 3 includes a shaped top surface with small, lateral undercuts 17 for smooth engagement with wheels 13, that extend downward from the bottom of panel 15. Panel 15 has a stout perimeter 19 of metal or wood construction, panel inserts of glass or wood, and generally is quite heavy. It is preferred that track 3 be extruded, such as from aluminum or other extrudable metal, in a single piece with base 5. Such extrusion further includes flanges 21, extending outward from both sides of base 5.

Figure 3:
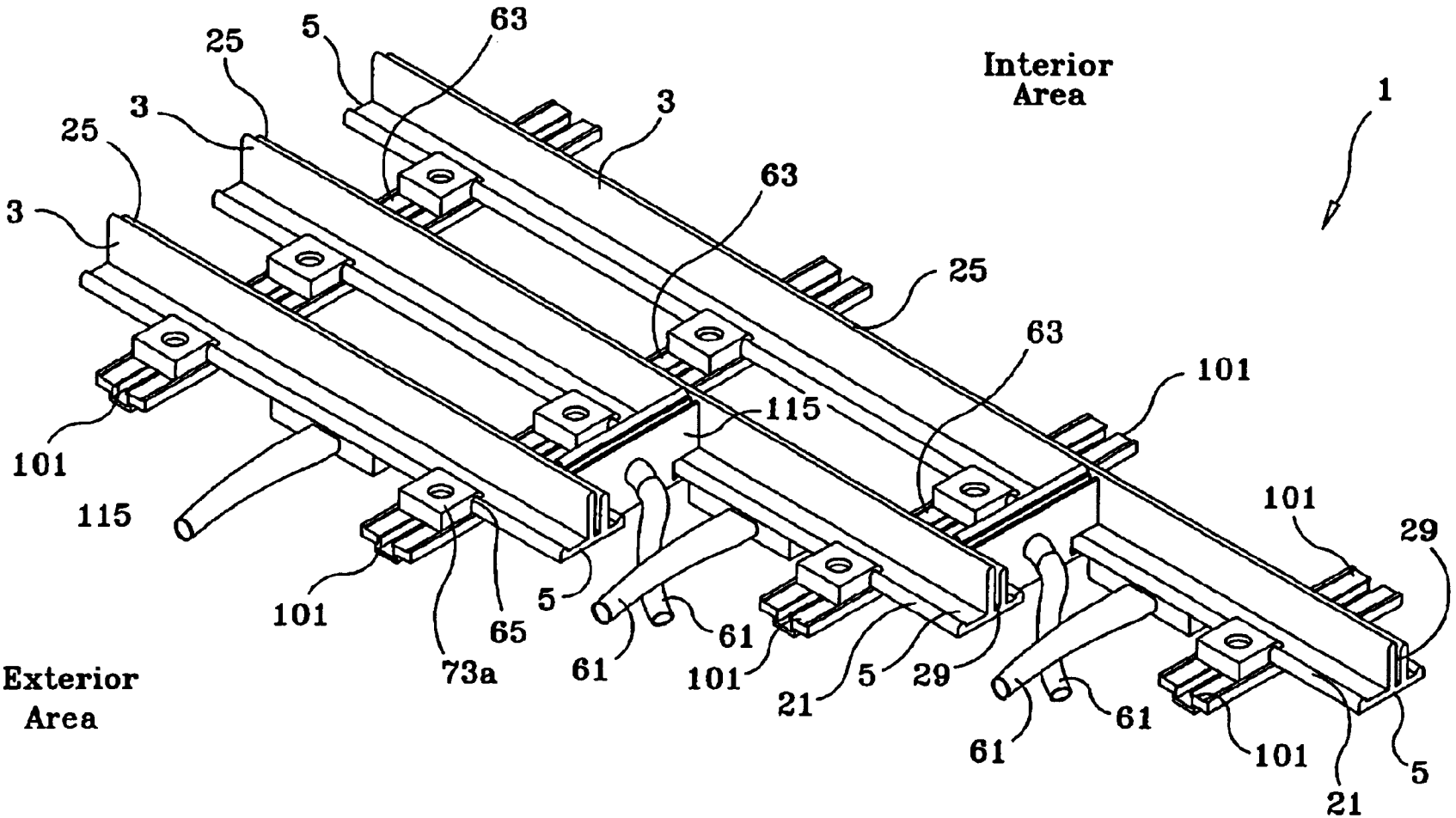
FIG. 3 is an illustrative view of a multiple track and weep system according to this invention.

FIG. 3 shows an in-floor, adjustable, multiple configuration track assembly for a plurality of sliding panels 15 (not shown), each with a built-in weep system of this invention, and shows a plurality of narrow, elongated tracks 3 in closely spaced-apart, parallel arrangement, each track 3 extending upward from a separate base 5, for engaging and supporting the undercarriage of at least one panel on each track 3 while said panels are in motion, such as rectilinear motion, thereon. It is important to this invention that track top surface 17 protrudes or extends slightly above finished floor top surface 7 (see FIG. 2) to form a slight barrier to transverse flow of water or moisture across track 3 from the exterior area to the interior area.

As shown in FIGS. 1–4, an upright splash guard 25 is provided for each of narrow tracks 3, parallel to and spaced slightly apart therefrom a distance sufficient to capture moisture either dripping or running off panel 15, shown as drops 27, or running across finished floor top surface 7 and over the top of track 3 from the exterior area toward the interior area. Splash guard 25 forms, with each track 3 and base 5, a narrow channel 29 for collecting moisture from the bottom of each panel 15. When used herein, the term "moisture" means rain, sleet, snow, and water splashed from swimming pools, hoses and the like. Moisture is shown as angled straight lines in the exterior area in FIG. 2. As shown in FIG. 2, track 3 and splash guard 25 are both upright, elongated, narrow-gauge plates and, together, form an inverted "T" shape with base 5. In addition, it is preferred that splash guard 25 terminates or "tops" at finished floor top surface 7 so that the entire assembly is at or below top surface 7, except for a slight upward protrusion of track top surface 17 and thus forms a very smooth, uninterrupted top floor surface. This configuration conforms to the requirements of the Americans with Disabilities Act (42 U.S.C §12100 et sec.). Since splash guard 25 and track 3 together form a substantially inverted "T" with base 5, it is preferred that they all be extruded together in one monolithic piece from metal such as aluminum. If not possible, it is preferred that track 3 and base 5 be extruded as one piece and splash guard 21 installed, as shown, and soldered or otherwise rigidly mounted in base 5.

Figure 2A:
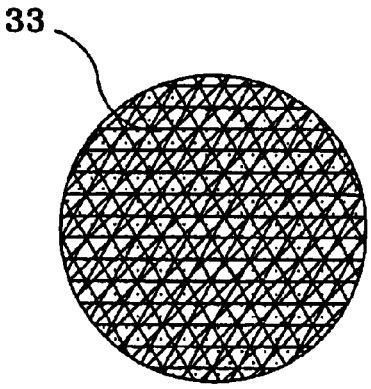
FIGS. 2*a* and 2*b* are small sectional views of two materials useful in the narrow moisture collection channel.
Figure 2B:
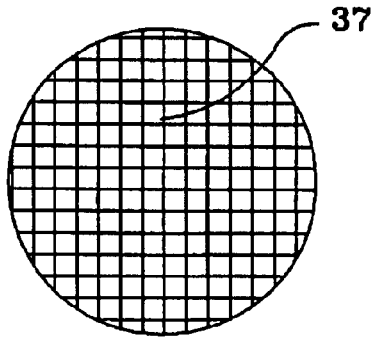

A filter means 31 is located in said channel 29 for preventing the ingress of debris. As shown in FIG. 2*a*, filter means 31 may take the form of a strip of highly reticulated plastic foam 33 cut and inserted into channel 29. As shown in FIG. 2*b*, a piece of screen 37 may be cut and folded in a shape and slipped into channel 29. Not only do these means prevent the ingress of debris while also not interfering with the collection of moisture, they also are easily removed so that they can be renewed without significant cost or effort.

Figure 4:
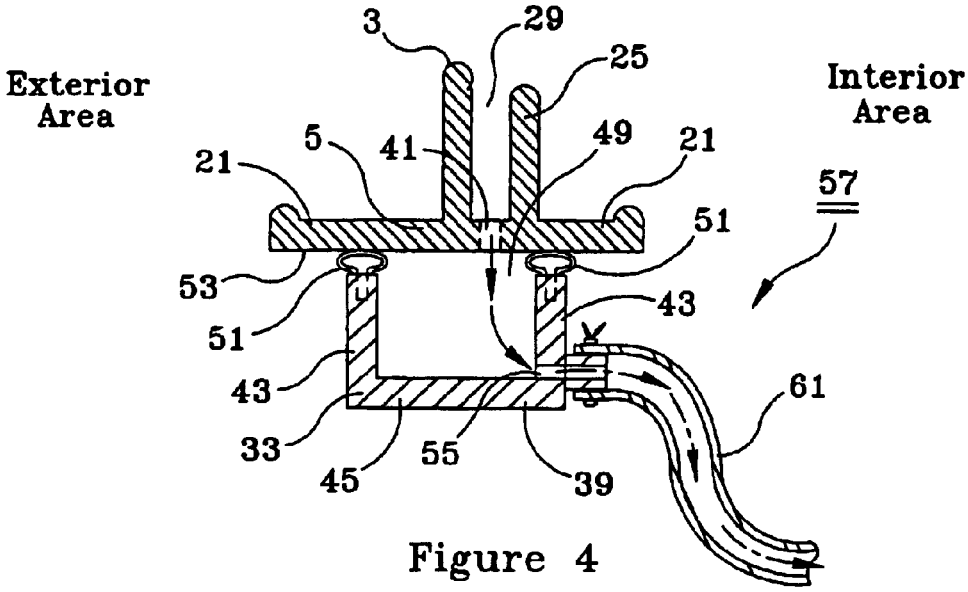
FIG. 4 is a cross-sectional view of the rail of this invention showing the moisture collection pan mounted underneath.
Figure 5:
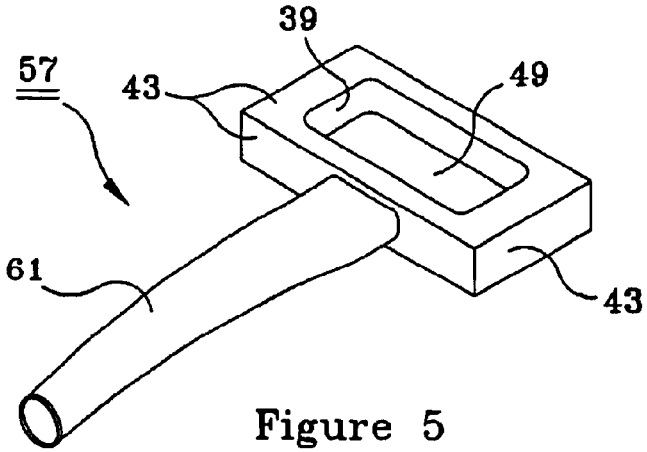
FIG. 5 is an illustrative view of the moisture collection pan of this invention.

As shown in FIGS. 4 and 5, at least one collection pan 39 is mounted under each channel 29 and is accessible through at least one aperture 41 formed in the bottom of channel 29, preferably at the bottom of channel 29 in base 5. Collection pan 39 collects moisture that runs down into channel 29. Collection pan 39 is preferably made from plastic, such as polyvinyl chloride, polyvinylidine chloride, polyethylene, and the like, and can be easily injection molded to reduce the cost of production. As shown in FIGS. 4 and 5, collection pan 39 comprises enclosed sidewalls 43, a closed bottom 45, and an open top cavity 49 formed therein. Sidewalls 43 are attached through gaskets 51, along their top surfaces, to the bottom surface 53 of base 5 and cavity 49 is preferably arranged directly below aperture 41 to receive moisture as it drops from the panels into channel 29 and through filter means 31. An opening 55, preferably located in or near collection pan bottom 45 is provided and egress means 57, such as a hose or tube 61, is attached thereto to draw off the moisture from the bottom of said panels.

As shown in the Figures, at least two track support rails 63 are provided, in spaced-apart arrangement, running transversely underneath tracks 3, splash guards 25, and bases 5. As further shown in FIG. 6, rails 63 extend outward, in orthogonal arrangement from track bases 5 and each rail 63 includes a rail body 65, defined by a bottom surface 67 and a top surface 69. A pair of alignment clamps 73*a* and 73*b* are provided for each track, for assembly with rails 63 to fasten each track to each rail. As shown in FIG. 1, the alignment between tracks 3 and rails 63 is orthogonal, i.e., each track is adjusted to be as close as possible to perpendicular from each rail. Each clamp 73*a* and 73*b* includes a bottom clamp surface 75, a portion 77 of which is shaped for overlapping contact with a curb 79*a* and 79*b* formed on track flanges 21 on both sides of track 3.

Figure 6:
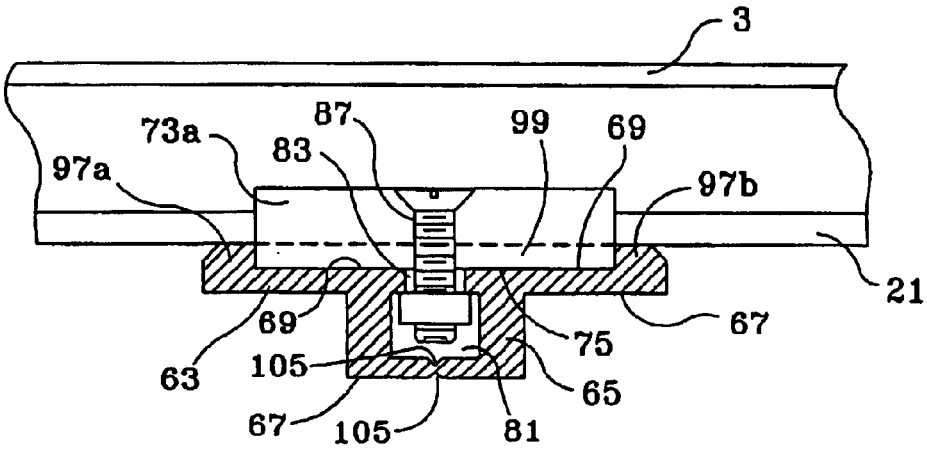
FIG. 6 is a sectional view of the track and rail of this invention taken orthogonally to the view of FIG. 2.

As shown in FIG. 6, a C-shaped groove 81 is formed in track support rail body 63 opening upward through a slot 83 formed in rail body top surface 69. An aperture 87 is formed in alignment clamps 73*a* and 73*b* for arrangement over upwardly opening C-shaped groove 81. As shown in FIGS. 3 and 6, clamps 73*a* and 73*b* are assembled with track 3 and track support rail 63 such that track 3 is overlaid rail 63 and clamps 73*a* and 73*b* placed on rail 63, one on each side thereof, with portion 77 of clamp bottom surface 75 overlaying flange 21 with slot 85 aligned with aperture 87.

A threaded means 89, such as a flat headed bolt or machine screw 91, is inserted down through aperture 87, through slot 85, and into a bolt-capturing nut 93 located in C-shaped groove 81. Nut 93 is wider than slot 85 but smaller than the maximum internal width of C-shaped groove 81 so that it is captured in groove 81 yet is slightly moveable therein. It is preferred that the outside diameter of bolt 91 be made slightly less than the width of slot 85 to allow for some movement between bolt 91, track 3 and rail 63. This slight looseness allows track 3 and rail 63 to be adjusted horizontally in the floor on which track 3 will be mounted and further allows track 3 and rail 63 to be brought as close as possible to orthogonal arrangement during assembly. It is preferred that bolt 91 have a flat heat with conical sides, as shown in FIG. 6, and aperture 87 in clamps 73*a* and 73*b* have a top chamfer to accept the flat bolt head so that the flat head of bolt 91 will lie flush with the top surface of alignment clamps 73*a* and 73*b*.

To aid the location of alignment clamps 73*a* and 73*b* on top surface 69 of track support rail 63, as shown in FIG. 6, it is preferred that a pair of upsets or curbs, 97*a* and 97*b*, be formed in spaced-apart arrangement on track support rail top surface 69 that, together, form a wide, substantially "U"-shaped depression 99 in rail top surface 69. Alignment clamps 97*a* and 97*b* are preferably made just wide enough to fit into said depression 99 and aligned therein for assembly with track 3 and rail 63 to prevent the clamps from moving about when the assembly is subjected to the movement of panels 15 on tracks 3.

Figure 7:
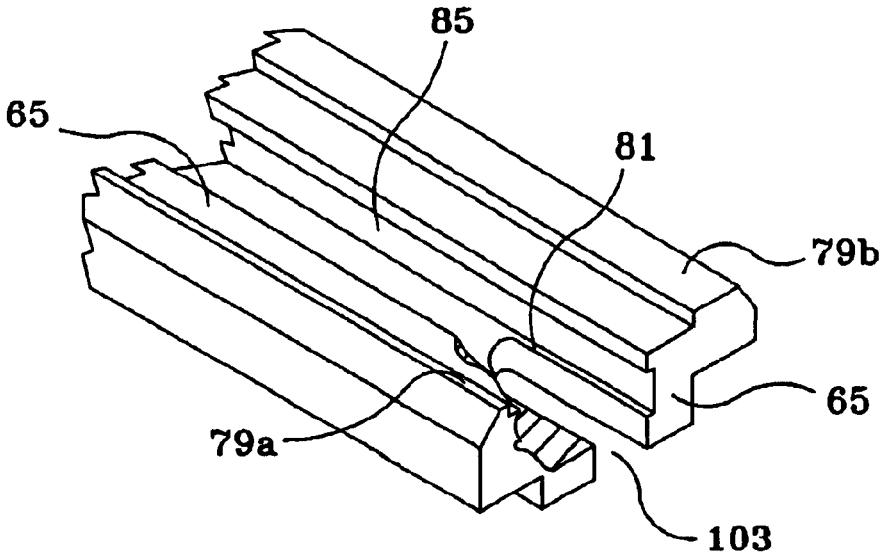
FIG. 7 is an illustrative view of the side mounting tab formed on the rails of this invention; and, FIG. 8 is a perspective view of a moisture trap used in this invention.

As shown in FIGS. 3 and 7, a side mounting tab 101 is formed as an extension on the ends of track support rails 63. An adjustment/mounting slot 103 is formed in rail body 65, preferably at the center of C-shaped groove 81, and through the bottom of rail body 65. As shown in FIG. 6, an elongated, slightly V-shaped indentation 105 is formed in the upper surface of the bottom surface of groove 81 and, preferably, along the center-line of rail bottom surface 67 for aiding in aligning a drill bit to drill through the bottom of rail body 65 in order to center the drill bit used in forming adjustment mounting slot 103.

As shown in FIG. 2, in assembling tracks 3 and rails 63 on the surface wherein the panels are to slide, a first pair of threaded studs 109 is mounted in the cement sub-floor 111 or in the wood sub-floor or other support surface, in spaced-apart arrangement, a distance equal to the distance between adjusting/mounting slots 103 that are formed at each end of rail 63, and along an axis orthogonal to the axis of intended travel of the panels. Rail 63 is then set down on studs 109 and is shimmed to level. A first pair of bolt-capturing nuts 113 is then placed in threaded engagement on studs 109 and tightened down against that portion of rail body 65 at the bottom of C-shaped groove 81 and fastened into place to provide rigid support for the entire assembly. Tracks 3 are then placed on top of rails 63 and alignment clamps 73*a* and 73*b* are placed on rail top surface 69, one on each side of track 3 and partially overlapping onto track flanges 21. Flat-headed bolts or machine screws 91 are then inserted into clamp aperture 87 and passed down into threaded receipt in bolt-capturing nuts 93 that are first slipped inside C-shaped groove 81, in rail body 65. Nuts 93 are then tightened down to rigidify the assembly. It is preferred that tracks 3 be orthogonal or perpendicular to rails 63 when the full assembly is rigidified. As shown in FIGS. 3 and 4, collection pans 39, already mounted under rails 63 are connected to hoses 61 to be passed through holes in the sub-floor, preferably to an outside vent for removing the collected moisture from tracks 3.

Figure 8:
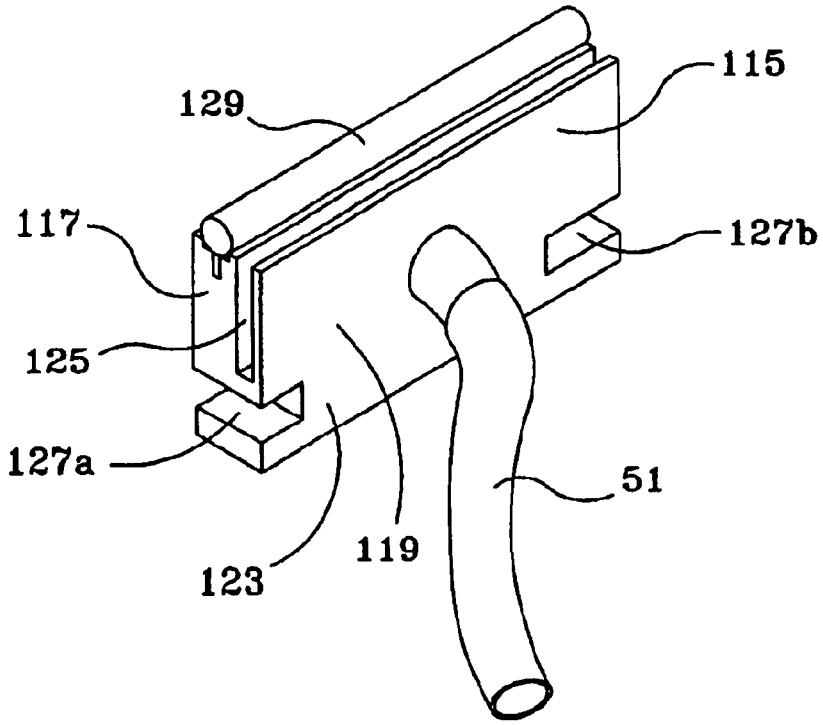

As shown in FIGS. 3 and 8, a trap 115 may be located transversely between at least two adjacent tracks 3 that are in closely spaced-apart, passing arrangement, in order to collect the moisture that impacts the ends of panels 15 and runs down toward the underlying tracks 3. Panel perimeters 19 often are wide in order to support heavy panel inserts, such as glass panes and wood sheeting. This transverse thickness of the perimeter presents a rather broad surface for moisture to impact and trickle downward. Trap 115 is shown in FIG. 8 to comprise a pair of closely spaced-apart, parallel walls 117 and 119 and a closed base 123 forms an open top U-shaped duct 125 therebetween. A pair of outwardly directed positioning slots 127*a* and 127*b* are formed in base 123 for sliding over inwardly-facing flanges 21 on the two adjacent track bases 5. Mounted along the top of wall 117 is a pliable seal 129 for the purpose of contacting panel undercarriage 13 to seal trap 115 against leakage of moisture entering duct 125. Filter means 31, as previously disclosed, may also be inserted in duct 125 to prevent the ingress of debris along with the entrance of moisture. At least one collection pan 39 is mounted under each transverse trap 115 and is accessible through an aperture 87, located at the bottom of duct 125 to pass moisture from duct 129 to an egress means 57, such as hose 61, as previously disclosed.

As shown in FIG. 2, sub-floor 111 is thereafter encased, about its sides and underneath, with additional sub-floor 131, in preparation of the laying of final or finished floor 9 that closes off a view of the invention except for a small upper portion of tracks 3 and the very top of splash guard 25.

In some instances, splash guard 25 and narrow channel 29 may be located on the exterior area of the assembly, however, it is preferred that they be located on the interior area of the assembly.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. An in-floor, adjustable, track assembly with built-in weep system for sliding panels, comprising:

a) a base having a track extending upward therefrom, slightly above a finished floor level, and arranged to engage undercarriage wheels of at least one vertically-oriented panel and support motion of said panel therealong to divide an area about said track into an exterior section and an interior section;

b) an upright splash guard, located parallel to and spaced slightly apart from said track, in said interior section of said area, and topping at the level of the finished floor, said splash guard forming an open-top channel with said track and said base, for collecting moisture therein;

c) at least one collection pan mounted under each said channel, in communication with said channel, to collect moisture from said channel;

d) egress means for drawing off the moisture from said collection pan;

e) a pair of alignment clamps, each said clamp including a surface for overlapping contact with at least a portion of said base, for arrangement on opposite sides of said track base;

f) means for attaching said clamps to said base and to a track support rail located underneath said base so as to secure said base to said track support rail; and g) means for securing said track support rail with respect to said floor.

2. The in-floor, adjustable, track assembly with built-in weep system for sliding panels, of claim 1, wherein said means for attaching said clamps further including:

a) a groove formed in said track support rail opening upward toward a bottom surface of a respective one of said pair of alignment clamps;

b) apertures formed in said alignment clamps and configured to be positioned above said groove formed in said track support rail; and, c) affixing means for passing through said apertures and into said groove so as to secure said alignment clamps to said track support rail.

3. The In-floor, adjustable, track assembly with built-in weep system for sliding panels, of claim 2, wherein said affixing means includes:

a) a threaded bolt configured to pass through said aperture in said alignment clamp and into said groove;

b) a bolt-capturing nut positioned in said groove and configured for threaded receipt of said bolt;

c) wherein said groove includes a first portion that opens upward toward a top surface of said track support rail and is slightly wider than a diameter of said bolt but narrower than a diameter of said nut; and, d) wherein said groove includes a second portion located below said first portion having an area that is slightly wider than said bolt-capturing nut, to allow said bolt and said nut to be adjusted in position.

4. The in-floor, adjustable, track assembly with built-in weep system for sliding panels of claim 1, further including deformable seals formed along top edges of said track and said splash guard to prevent leakage of moisture during collecting moisture from said panels.

5. The in-floor, adjustable, track assembly with built-in weep system for sliding panels of claim 1 further including filter means in said channel for preventing the ingress of debris into said channel and said collection pan.

6. A built-in weep system for slidable panels, comprising:

a) at least two bases, each having a track extending upward therefrom, said tracks arranged in closely spaced-apart, parallel manner, for engaging undercarriages of at least two, vertically-oriented panels, one said panel supported on each said track for motion therealong, each of said tracks dividing an area thereabout into an exterior section and an interior section;

b) at least two upright splash guards, each parallel to a respective one of said tracks, extending upward from each base, and each spaced slightly apart from a respective one of said tracks, topping at the level of a finished floor, each said splash guard forming an open-top channel with a respective one of said tracks and said bases for collecting moisture therein;

c) at least one collection pan mounted under each said channel to collect moisture from said channels; and, d) egress means for drawing off the moisture from each of said collection pans.

7. The built-in weep system for slidable panels of claim 6 wherein said tracks are upright, elongated, narrow gauge plates that form inverted "T" shapes with said respective bases.

8. The built-in weep system for slidable panels of claim 6 wherein said tracks each include a shaped top surface for engagement with wheels included in the undercarriage of a respective one of said vertically-oriented panels.

9. The built-in weep system for slidable panels of claim 6 wherein each of said tracks are extruded as a single piece with a respective one of said bases.

10. The built-in, weep system for slidable panels of claim 6 wherein said tracks and said upright splash guards are upright, elongated, narrow gauge plates and, together, form an inverted "T" shape with respective ones of said bases.

11. The built-in weep system for slidable panels of claim 6 wherein each of said splash guards terminate approximately at the level of the finished floor and each of said upright tracks extend slightly above said finished floor and, wherein each said splash guard together with a respective track and base, form respective ones of said channels therebetween.

12. The built-in weep system for slidable panels of claim 6 further including filter means in said channels for preventing the ingress of debris into said channels and said collection pans.

13. The built-in weep system for slidable panels of claim 6 wherein said bases each include flanges extending outward on both sides thereof.

14. The built-in weep system for slidable panels of claim 6 wherein said egress means for drawing off the moisture from said collection pans include an aperture formed in each said collection pan and a flexible tube connected to each said aperture for conveying the moisture away from said pans.

* * * * *